US011644854B2

(12) United States Patent
Chen

(10) Patent No.: US 11,644,854 B2
(45) Date of Patent: May 9, 2023

(54) LDO, MCU, FINGERPRINT MODULE AND TERMINAL DEVICE

(71) Applicant: Shenzhen Goodix Technology Co., Ltd., Shenzhen (CN)

(72) Inventor: Jianxing Chen, Shenzhen (CN)

(73) Assignee: Shenzhen Goodix Technology Co., Ltd., Shenzhen (CN)

( * ) Notice: Subject to any disclaimer, the term of this patent is extended or adjusted under 35 U.S.C. 154(b) by 311 days.

(21) Appl. No.: 17/106,587

(22) Filed: Nov. 30, 2020

(65) Prior Publication Data

US 2021/0132644 A1 May 6, 2021

Related U.S. Application Data

(63) Continuation of application No. PCT/CN2019/115716, filed on Nov. 5, 2019.

(51) Int. Cl.

*G05F 1/575* (2006.01)
*G05F 3/24* (2006.01)
*G05F 1/567* (2006.01)

(52) U.S. Cl.

CPC ..... *G05F 1/575* (2013.01); *G05F 1/567* (2013.01); *G05F 3/245* (2013.01)

(58) Field of Classification Search

CPC ..... G05F 3/245; G05F 1/575; G05F 1/567
See application file for complete search history.

(56) References Cited

U.S. PATENT DOCUMENTS 10,222,818 B1 * 3/2019 Lin ..... G05F 1/468
2006/0132224 A1 * 6/2006 Kedilaya ..... G05F 3/267 327/538
2013/0300393 A1 11/2013 Lee
2019/0087622 A1 * 3/2019 Benkley, III ..... G06V 40/1329
2020/0201373 A1 * 6/2020 Koay ..... G05F 1/59

FOREIGN PATENT DOCUMENTS

CN 103455076 A 12/2013
CN 108008755 A 5/2018
CN 109308087 A 2/2019
CN 111221369 B * 1/2022 ..... G05F 1/461

OTHER PUBLICATIONS

International Search Report and Written Opinion dated Jul. 20, 2020 in corresponding International Application No. PCT/CN2019/115716; 9 pages.
Extended European Search Report dated Jun. 21, 2021, in connection with corresponding EP Application No. 19929195.6; 10 pages.

* cited by examiner

*Primary Examiner* — Jue Zhang
(74) *Attorney, Agent, or Firm* — Maier & Maier, PLLC

(57) ABSTRACT

Provided are an LDO, an MCU, a fingerprint module and a terminal device. The LDO includes: a reference voltage generating circuit and a source follower connected to the reference voltage generating circuit. The reference voltage generating circuit is used to generate a reference voltage that changes with temperature to offset a voltage change caused by a voltage between a first terminal and a second terminal of the source follower changing with time, so that an output voltage of the second terminal of the source follower does not change with temperature. The LDO omits an operational amplifier EA and a resistor divider feedback network in the prior art, which not only has a simple circuit structure, but also can achieve ultra-low power consumption.

14 Claims, 2 Drawing Sheets

LDO, MCU, FINGERPRINT MODULE AND TERMINAL DEVICE

CROSS-REFERENCE TO RELATED APPLICATIONS

This application is a continuation of the International application PCT/CN2019/115716, filed on Nov. 5, 2019, entitled "LDO, MCU, FINGERPRINT MODULE AND TERMINAL DEVICE", the content of which is hereby incorporated by reference in its entirety.

TECHNICAL FIELD

The present application relates to the field of circuit technology, and in particular, to an LDO, an MCU, a fingerprint module and a terminal device.

BACKGROUND

With the development of linear regulators, a low dropout regulator (Low Dropout Regulator, LDO) has replaced traditional linear regulators and has been applied more and more.

FIG. 1 is a schematic structural diagram of an LDO commonly used in the prior art. As shown in FIG. 1, the existing LDO includes: a reference voltage generating circuit, an operational amplifier EA, an adjustment output tube M0, and a resistor divider feedback network (for example, including a resistor R1 and a resistor R2), where the reference voltage generating circuit may be a bandgap reference source circuit that does not change with temperature. Specifically, an output voltage of the LDO is divided by the resistor divider feedback network and is then, together with a reference voltage generated by the reference voltage generating circuit, input to the operational amplifier EA for comparison. The operational amplifier EA amplifies a difference between the two and drives the adjustment output tube to increase or reduce an output current so as to adjust an output voltage to achieve a goal of stabilizing the output voltage.

It can be seen that the LDO in the prior art includes the operational amplifier EA and the resistor divider feedback network, etc., which not only have a complicated structure, but also have relatively large power consumption, and thus cannot be applied to application scenarios with a requirement of low power consumption.

SUMMARY

The present application provides an LDO, an MCU, a fingerprint module, and a terminal device so as to solve a problem that an LDO in the prior art cannot be applied to application scenarios with a requirement of low power consumption.

In a first aspect, the present application provides a low dropout regulator (LDO), including: a reference voltage generating circuit and a source follower, a first terminal of the reference voltage generating circuit is connection to a first terminal of the source follower, a second terminal of the reference voltage generating circuit is grounded, and a second terminal of the source follower is used to connect to a load circuit;

where the reference voltage generating circuit is configured to generate a reference voltage that changes with temperature, to offset a voltage change caused by a voltage between the first terminal and the second terminal of the source follower changing with temperature.

As an optional manner, the reference voltage generating circuit includes: a first NMOS (N-Metal-Oxide-Semiconductor) transistor and an adjustable resistor, and a gate and a drain of the first NMOS transistor are connected to the first terminal of the source follower, and a source of the first NMOS transistor is grounded through the adjustable resistor.

As an optional manner, the gate and the drain of the first NMOS transistor are further configured to receive a bias current Iptc having an adjustable temperature coefficient.

As an optional manner, the source follower includes: a second NMOS transistor, where a gate of the second NMOS transistor is connected to the drain of the first NMOS transistor, and a source of the second NMOS transistor is used to connect to the load circuit, and a drain of the second NMOS transistor is connected to a power supply voltage.

As an optional manner, the first NMOS transistor and the second NMOS transistor are of a same type, and a channel length of the first NMOS transistor is the same as a channel length of the second NMOS transistor.

As an optional manner, the adjustable resistor is a low temperature drift resistor.

As an optional manner, the source of the second NMOS transistor is grounded through a stabilizing capacitor.

In a second aspect, the present application provides a microcontroller unit (Microcontroller Unit, MCU), including: the LDO according to the optional manners of the first aspect described above.

In a third aspect, the present application provides a fingerprint module, including: the MCU according to the second aspect described above.

In a fourth aspect, the present application provides a terminal device including: the fingerprint module according to the third aspect described above.

The present application provides an LDO, an MCU, a fingerprint module and a terminal device. The LDO includes: a reference voltage generating circuit and a source follower connected to the reference voltage generating circuit. The reference voltage generating circuit is configured to generate a reference voltage that changes with temperature to offset a voltage change caused by a voltage between a first terminal and a second terminal of the source follower changing with the temperature, so that an output voltage of the second terminal of the source follower does not change with temperature. It can be seen that, compared with the LDO in the prior art, the LDO provided in embodiments of the present application omits the operational amplifier EA and the resistor divider feedback network in the prior art, which not only has a simple circuit structure, but also can achieve ultra-low power consumption, and in the meantime, can realize an output voltage that does not change with temperature, and thus can be applied to application scenarios with a requirement of lower power consumption.

BRIEF DESCRIPTION OF DRAWINGS

In order to more clearly illustrate technical solutions in embodiments of the present application or the prior art, drawings that need to be used in the description of the embodiments or the prior art will be briefly introduced in the following. Obviously, the drawings in the following description are some embodiments of the present application. For those of ordinary skill in the art, other drawings can be obtained based on these drawings without creative effort.

DESCRIPTION OF EMBODIMENTS

Figure 1:
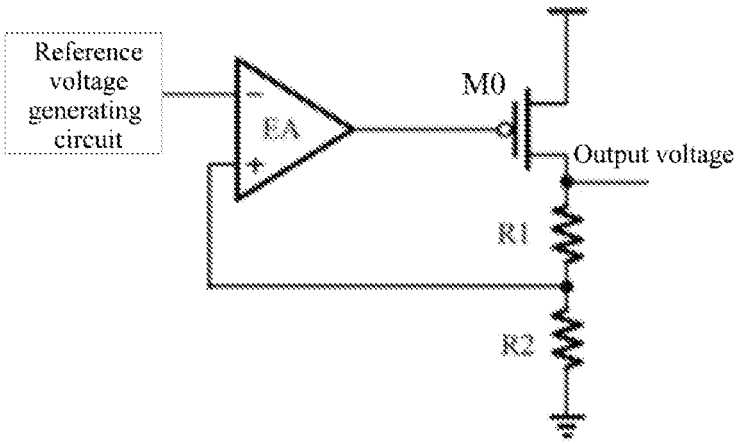
FIG. 1 is a schematic structural diagram of an LDO commonly used in the prior art.

In order to make the purpose, technical solutions, and advantages of embodiments of the present application more clearly, the technical solutions in the embodiments of the present application will be described clearly and completely in conjunction with the drawings in the embodiments of the present application. Obviously, the described embodiments are part of the embodiments of the present application, rather than all of the embodiments. Based on the embodiments in the present application, all other embodiments obtained by those of ordinary skill in the art without creative effort shall fall within the protection scope of the present application.

The terms "first", "second", etc. (if any) in the description and claims and the above-mentioned drawings of the present application are used to distinguish similar objects, and need not be used to describe a specific order or sequence. It should be understood that the terms used in this way may be interchanged under appropriate circumstances, so that the embodiments of the present application described herein can be implemented for example in a sequence other than those illustrated or described herein.

In addition, the terms "include" and "have" and any variations of them are intended to cover a non-exclusive inclusion, for example, processes, methods, systems, products or devices that include a series of steps or units are not necessarily limited to those clearly listed steps or units, but may include other steps or units that are not clearly listed or are inherent to these processes, methods, products or devices.

First, an application background and some terms involved in embodiments of the present application are introduced.

An LDO in the prior art includes an operational amplifier EA and a resistor divider feedback network, etc. The LDO in the prior art not only has a relatively complicated structure, but also has relatively large power consumption, and thus cannot be applied to application scenarios with a requirement of low power consumption.

Aiming at the above problem, the embodiments of the present application provide an LDO, an MCU, a fingerprint module and a terminal device. The LDO includes: a reference voltage generating circuit and a source follower connected to the reference voltage generating circuit. The reference voltage generating circuit is configured to generate a reference voltage that changes with temperature to offset a voltage change caused by a voltage between a first terminal and a second terminal of the source follower changing with temperature, so that an output voltage of the second terminal of the source follower does not change with temperature. It can be seen that, compared with the LDO in the prior art, the LDO provided in the embodiments of the present application omits the operational amplifier EA and the resistor divider feedback network in the prior art, which not only has a simple circuit structure, but also can achieve ultra-low power consumption, and in the meantime, can realize the output voltage that does not change with temperature, and thus can be applied to application scenarios with a requirement of lower power consumption.

The reference voltage generating circuit involved in the embodiments of the present application is configured to generate a reference voltage $V_{ref}$ that changes with temperature, which is used as an input voltage of a first terminal of the source follower.

A second terminal of the source follower involved in the embodiments of the present application is used to connect to a load circuit, where a characteristic of the source follower includes: output voltage $V_{out}$ of the second terminal of the source follower=input voltage of the first terminal of the source follower (i.e. reference voltage $V_{ref}$)—voltage between the first terminal and the second terminal of the source follower. In addition, a third terminal of the source follower can be connected to a power supply voltage.

Optionally, the source follower in the embodiments of the present application may include but is not limited to: a second NMOS transistor, where a gate of the second NMOS transistor is used as the first terminal of the source follower to be connected to a first terminal of the reference voltage generating circuit, a source of the second NMOS transistor is used as a second terminal of the source follower to be connected to the load circuit, and a drain of the second NMOS transistor is used as the third terminal of the source follower to be connected to the power supply voltage.

Correspondingly, a characteristic of the source follower includes: output voltage $V_{out}$ of the source of the second NMOS transistor=input voltage of the gate of the second NMOS transistor (i.e. reference voltage $V_{ref}$)—voltage between the gate and the source of the second NMOS transistor.

The reference voltage generating circuit involved in the embodiments of the present application may include but is not limited to: a first NMOS transistor and an adjustable resistor, where a gate and a drain of the first NMOS transistor are used as the first terminal of the reference voltage generating circuit to be connected to the first terminal of the source follower, a source of the first NMOS transistor is connected to a first terminal of the adjustable resistor, and a second terminal of the adjustable resistor is used as a second terminal of the reference voltage generating circuit to be grounded.

Optionally, the gate and the drain of the first NMOS transistor may also be configured to receive a bias current having an adjustable temperature coefficient (Programmable Temperature Coefficient Current, Iptc).

The bias current having an adjustable temperature coefficient Iptc (or bias current Iptc for short) involved in the embodiments of the present application means that a temperature coefficient of the bias current is adjustable. For example, an adjustable range of the temperature coefficient may be −200 ppm/° C.~+200 ppm/° C., where the adjustable range of the temperature coefficient may include an end point value.

Illustratively, the bias current Iptc may be generated by a bias circuit having an adjustable temperature coefficient; of course, it may also be generated by other circuits for generating a current having an adjustable temperature coefficient, which is not limited in the embodiments of the present application.

The temperature coefficient involved in the embodiments of the present application refers to a rate at which a physical property of a material changes with temperature.

Illustratively, the adjustable resistor in the embodiments of the present application may be a low temperature drift resistor (or called a low temperature coefficient resistor), which refers to a precision resistor whose resistance is less affected by temperature changes.

Technical solutions of the present application will be described in detail below with specific embodiments. The following specific embodiments may be combined with each other, and same or similar concepts or processes may not be repeated in some embodiments.

Figure 2:
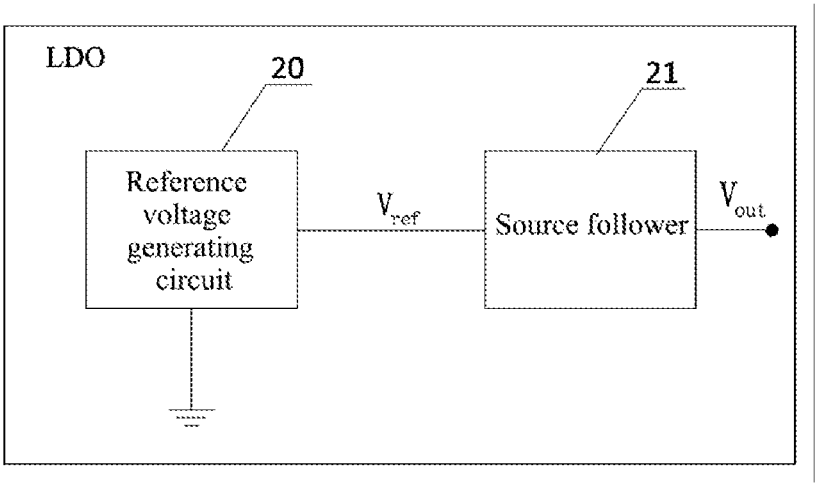
FIG. 2 is a schematic structural diagram of an LDO provided by an embodiment of the present application.

FIG. 2 is a schematic structural diagram of an LDO provided by an embodiment of the present application. As shown in FIG. 2, the LDO provided by the embodiment of the present application may include: a reference voltage generating circuit 20 and a source follower 21; where a first terminal of the reference voltage generating circuit 20 is connected to a first terminal of the source follower 21, a second terminal of the reference voltage generating circuit 20 is grounded, and a second terminal (or called output terminal) of the source follower 21 is used to connect to a load circuit (not shown in the figure).

A characteristic of the source follower includes: output voltage $V_{out}$ of the second terminal of the source follower 21=input voltage of the first terminal of the source follower (i.e. reference voltage $V_{ref}$ output by the first terminal of the reference voltage generating circuit 20)—voltage between the first terminal and the second terminal of the source follower.

Considering that the voltage between the first terminal and the second terminal of the source follower 21 will change with temperature, the reference voltage generating circuit 20 in the embodiment of the present application is configured to generate the reference voltage $V_{ref}$ that also changes with temperature to offset a voltage change caused by the voltage between the first terminal and the second terminal of the source follower 21 changing with temperature, so that the output voltage of the second terminal of the source follower 21 does not change with temperature.

For example, when the voltage between the first terminal and the second terminal of the source follower increases by ΔV with a change in temperature, the reference voltage $V_{ref}$ generated by the reference voltage generating circuit 20 also increases by ΔV, so that the output voltage $V_{out}$ of the second terminal of the source follower 21 does not change with temperature.

For another example, when the voltage between the first terminal and the second terminal of the source follower decreases by ΔV with a change in temperature, the reference voltage $V_{ref}$ generated by the reference voltage generating circuit 20 also decreases by ΔV, so that the output voltage $V_{out}$ of the second terminal of the source follower 21 does not change with temperature.

The LDO provided by the embodiments of the present application includes: the reference voltage generating circuit 20 and the source follower 21 connected to the reference voltage generating circuit 20, where the reference voltage generating circuit 20 is configured to generate the reference voltage $V_{ref}$ that changes with temperature to offset the voltage change caused by the voltage between the first terminal and the second terminal of the source follower changing with temperature, so that the output voltage of the second terminal of the source follower $V_{out}$ does not change with temperature. It can be seen that, compared with the LDO in the prior art, the LDO provided in the embodiments of the present application omits an operational amplifier EA and a resistance divider feedback network in the prior art, which not only has a simple circuit structure, but also can achieve ultra-low power consumption, and in the meantime, can realize the output voltage that does not change with temperature, and thus can be applied to application scenarios with a requirement of lower power consumption.

Figure 3:
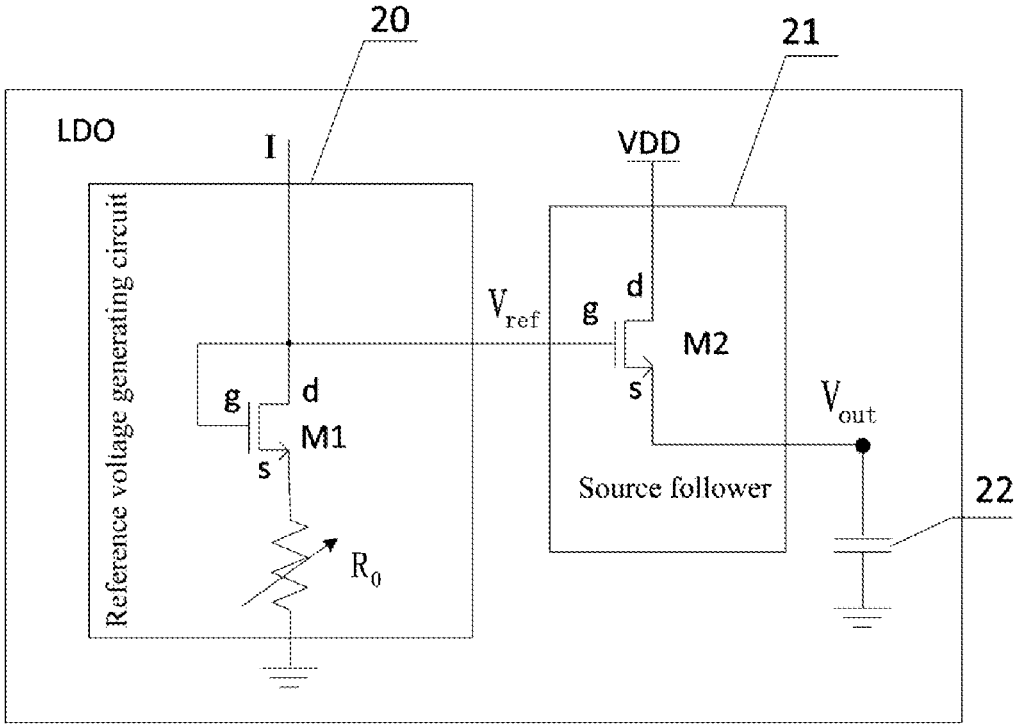
FIG. 3 is a schematic structural diagram of an LDO provided by another embodiment of the present application.

FIG. 3 is a schematic structural diagram of an LDO provided by another embodiment of the present application. On the basis of foregoing embodiments, this embodiment of the present application describes implementation manners of the above-mentioned reference voltage generating circuit 20 and foregoing source follower 21.

As shown in FIG. 3, the above-mentioned reference voltage generating circuit 20 may include: a first NMOS transistor M1 and an adjustable resistor $R_0$.

A gate g and a drain d of the first NMOS transistor M1 are used as a first terminal of the reference voltage generating circuit 20 to be connected to a first terminal of the source follower 21, and a source s of the first NMOS transistor M1 is connected to a first terminal of the adjustable resistor $R_0$, and a second terminal of the adjustable resistor $R_0$ is used as a second terminal of the reference voltage generating circuit 20 to be grounded. In addition, the gate g and the drain d of the first NMOS transistor M1 may also receive a supply current I.

Illustratively, the adjustable resistor $R_0$ in the embodiment of the present application may be a low temperature drift resistor (or called a low temperature coefficient resistor), which refers to a precision resistor whose resistance is less affected by temperature changes.

Illustratively, the reference voltage $V_{ref}$ generated by the above-mentioned reference voltage generating circuit 20 may be determined by following formula (1):

$$V_{ref}=I*R_0+V_{gsM1} \quad \text{formula (1)}$$

where $V_{gsM1}$ represents a voltage between the gate g and the source s of the first NMOS transistor M1.

It should be noted that the reference voltage $V_{ref}$ may also be determined by other equivalent or modified formulas of the above formula (1).

The $V_{gsM1}$ in the reference voltage generating circuit 20 provided by the embodiment of the present application changes with temperature, and can be used to offset a voltage change caused by the voltage between the first terminal and a second terminal of the source follower 21 changing with temperature, so that the output voltage $V_{out}$ of the second terminal of the source follower 21 does not change with temperature.

It should be noted that in the embodiment of the present application, the reference voltage $V_{ref}$ output by the reference voltage generating circuit 20 may also be adjusted by adjusting resistance of the adjustable resistor $R_0$ to meet requirements of different reference voltages $V_{ref}$.

Further, the above-mentioned supply current may be a bias current Iptc having an adjustable temperature coefficient, that is, the gate g and the drain d of the first NMOS transistor M1 may receive the bias current Iptc having an adjustable temperature coefficient, and correspondingly, it is also possible to adjust the temperature coefficient of the bias current Iptc to compensate for a temperature coefficient of the voltage between the first terminal and the second terminal of the source follower 21 (or in other words, to offset the voltage change caused by the voltage between the first terminal and the second terminal of the source follower 21 changing with temperature), so that the temperature coefficient of the output voltage $V_{out}$ of the second terminal of the source follower 21 is 0, that is, $V_{out}$ does not change with temperature. It should be understood that by adjusting the temperature coefficient of the bias current Iptc, the temperature coefficient of the adjustable resistor $R_0$ and/or the temperature coefficient of $V_{gsM1}$ can also be compensated for.

As shown in FIG. 3, the source follower 21 may include: a second NMOS transistor M2, where a gate g of the second NMOS transistor M2 is used as the first terminal of the source follower 21 to be connected to the drain d of the first NMOS transistor M1 to obtain the reference voltage $V_{ref}$ generated by the reference voltage generating circuit 20, a source s of the second NMOS transistor M2 is used as the second terminal of the source follower 21 to be connected to a load circuit, and a drain d of the second NMOS transistor M2 is used as a third terminal of the source follower 21 to be connected to a power supply voltage VDD.

Illustratively, a characteristic of the source follower 21 includes: output voltage $V_{out}$ of the source s of the second NMOS transistor M2=input voltage of the gate g of the second NMOS transistor M2 (i.e., reference voltage $V_{ref}$)—voltage $V_{gsM2}$ between the gate g and the source s of the second NMOS transistor M2.

Combined with the above formula (1), the output voltage $V_{out}$ of the source s of the second NMOS transistor M2 may be determined by the following formula (2):

$$V_{out}=V_{ref}-V_{gsM2}=I*R_0+V_{gsM1}-V_{gsM2} \quad \text{formula (2)}$$

It should be noted that the output voltage $V_{out}$ of the source s of the second NMOS transistor M2 may also be determined by other equivalent or modified formulas of the above formula (2).

In the embodiment of the present application, $V_{gsM1}$ and $V_{gsM2}$ will change with temperature, and the change of $V_{gsM1}$ with temperature can be used to offset the change of $V_{gsM2}$ with temperature, so that the output voltage $V_{out}$ of the source s of the second NMOS transistor M2 does not change with temperature.

It should be noted that if the supply current I in the above formula (2) is the bias current Iptc having an adjustable temperature coefficient, it is further possible to adjust the temperature coefficient of the bias current Iptc to compensate for the temperature coefficient of $V_{gsM2}$ (or in other words, to offset the change of $V_{gsM2}$ with temperature), so that the temperature coefficient of the output voltage $V_{out}$ of the source s of the second NMOS transistor M2 is 0, that is, $V_{out}$ does not change with temperature. It should be understood that by adjusting the temperature coefficient of the bias current Iptc, the temperature coefficient of the adjustable resistor $R_0$ and/or the temperature coefficient of $V_{gsM1}$ can also be compensated for.

Optionally, in order that the change of $V_{gsM1}$ with temperature can be used to completely offset the change of $V_{gsM2}$ with temperature, the first NMOS transistor M1 and the second NMOS transistor M2 in the embodiment of the present application are a same type of NMOS transistor, and a channel length of the first NMOS transistor M1 is the same as that of the second NMOS transistor M2, and then a threshold voltage $V_{thM1}$ of the first NMOS transistor M1 is the same as a threshold voltage $V_{thM2}$ of the second NMOS transistor M2. Correspondingly, the above formula (2) may be transformed into the following formula (3):

$$\begin{aligned} V_{out} &= V_{ref} - V_{gsM2} = I*R_0 + V_{gsM1} - V_{gsM2} \quad \text{formula (3)} \\ &= I*R_0 + (V_{odM1} + V_{thM1}) - (V_{odM2} + V_{thM2}) \\ &= I*R_0 + V_{odM1} - V_{odM2} = I*R_0 + \Delta V_{od} \end{aligned}$$

where, $V_{odM1}$ represents an overdrive voltage of the first NMOS transistor M1, $V_{odM2}$ represents an overdrive voltage of the second NMOS transistor M2, and $\Delta V_{od}$ represents an overdrive voltage difference between the first NMOS transistor M1 and the second NMOS transistor M2.

It should be noted that the output voltage $V_{out}$ of the source s of the second NMOS transistor M2 may also be determined by other equivalent or modified formulas of the above formula (3).

In the embodiment of the present application, since the first NMOS transistor M1 and the second NMOS transistor M2 are the same type of NMOS transistor, and the channel length of the first NMOS transistor M1 is the same as the channel length of the second NMOS transistor M2, the threshold voltage $V_{thM1}$ of the first NMOS transistor M1 is the same as the threshold voltage $V_{thM2}$ of the second NMOS transistor M2, the change of $V_{gsM1}$ with temperature can thus be used to completely offset the change of $V_{gsM2}$ with temperature. In order to make the output voltage $V_{out}$ not change with temperature, the above-mentioned adjustable resistor $R_0$ may be a low temperature drift resistor, and the above-mentioned supply current I may be a bias current Iptc that does not change with temperature.

Illustratively, for application scenarios where an output current of the LDO does not change much (such as a sleep mode or a standby mode of an MCU), $\Delta V_{od}$ is close to 0. It can be seen that the output voltage $V_{out}$ is only related to the bias current Iptc having an adjustable temperature coefficient, and the adjustable resistor $R_0$, where the adjustable resistor $R_0$ may be a low temperature drift resistor, or a zero temperature coefficient resistor composed of a combination of resistors with different temperature coefficients. The above-mentioned supply current may be a bias current Iptc that does not change with temperature, so that the output voltage $V_{out}$ does not change with temperature.

As another example, for application scenarios where $\Delta V_{od}$ is not close to 0, the temperature coefficient of the bias current Iptc may be adjusted to compensate for the temperature coefficient of the adjustable resistor $R_0$ and/or the temperature coefficient of $\Delta V_{od}$ (if the temperature coefficient of $\Delta V_{od}$ is not zero), so that the output voltage $V_{out}$ does not change with temperature.

In summary, the LDO provided by the embodiments of the present application includes: the reference voltage generating circuit 20 and the source follower 21 connected to the reference voltage generating circuit 20; the reference voltage generating circuit 20 includes the first NMOS transistor M1 and the adjustable resistor $R_0$, and the source follower 21 includes the second NMOS transistor M1, where the reference voltage generating circuit 20 is configured to generate the reference voltage $V_{ref}$ that changes with temperature, to offset the voltage change caused by the voltage between the gate g and the source s of the second NMOS transistor M2 changing with temperature, so that the output voltage $V_{out}$ does not change with temperature. It can be seen that, compared with the LDO in the prior art, the LDO provided in the embodiments of the present application omits the operational amplifier EA and the resistor divider feedback network in the prior art, which not only has a simple circuit structure, but also can achieve ultra-low power consumption, and in the meantime, can realize the output voltage that does not change with temperature, and thus can be applied to application scenarios with a requirement of lower power consumption.

Further, on the basis of the foregoing embodiment, as shown in FIG. 3, the source s of the second NMOS transistor M2 in the embodiment of the present application may also be grounded through a stabilizing capacitor 22, where the stabilizing capacitor 22 is used to keep the voltage input to the load circuit basically unchanged as much as possible, so as to ensure the normal operation of the load circuit as much as possible.

It should be noted that the aforementioned stabilizing capacitor 22 may also be replaced by other devices or circuits with a voltage stabilizing function.

An embodiment of the present application also provides an MCU, including: an LDO as provided in any of the foregoing embodiments of the present application, and the implementation principle and technical effect thereof are similar, and will not be repeated here.

An embodiment of the present application also provides a fingerprint module, including: an MCU as provided in the foregoing embodiment of the application.

An embodiment of the application also provides a terminal device, including: a fingerprint module as provided in the foregoing embodiment of the application.

Finally, it should be noted that the above embodiments are only used to illustrate the technical solutions of the present disclosure, but not to limit them; although the present disclosure has been described in detail with reference to the foregoing embodiments, those of ordinary skill in the art should understand: it is still possible to modify the technical solutions described in the foregoing embodiments, or equivalently replace some or all of the technical features; and these modifications or replacements do not make the essence of the corresponding technical solutions deviate from the range of technical solutions of the embodiments of the present disclosure.

What is claimed is:

1. A low dropout regulator (LDO), comprising: a reference voltage generating circuit and a source follower, a first terminal of the reference voltage generating circuit being connected to a first terminal of the source follower, a second terminal of the reference voltage generating circuit being grounded, and a second terminal of the source follower being used to connect to a load circuit;

wherein the reference voltage generating circuit is configured to generate a reference voltage that changes with temperature, to offset a voltage change caused by a voltage between the first terminal and the second terminal of the source follower changing with the temperature;

the reference voltage generating circuit comprises: a first N-Metal-Oxide-Semiconductor (NMOS) transistor and an adjustable resistor, and a gate and a drain of the first NMOS transistor are connected to the first terminal of the source follower, and a source of the first NMOS transistor is grounded through the adjustable resistor;

the source follower comprises: a second NMOS transistor, wherein a gate of the second NMOS transistor is connected to the drain of the first NMOS transistor, a source of the second NMOS transistor is used to connect to the load circuit, and a drain of the second NMOS transistor is connected to a power supply voltage, wherein the gate and the drain of the first NMOS transistor are further configured to receive a bias current Iptc having a-temperature coefficient, and the temperature coefficient is adjustable to offset the voltage change caused by the voltage between the first terminal and the second terminal of the source follower changing with the temperature;

the first NMOS transistor and the second NMOS transistor are of a same type, and a channel length of the first NMOS transistor is the same as a channel length of the second NMOS transistor, and then a threshold voltage $V_{thM1}$ of the first NMOS transistor is the same as a threshold voltage $V_{thM2}$ of the second NMOS transistor.

2. The LDO according to claim 1, wherein the adjustable resistor is a low temperature drift resistor, and the gate and the drain of the first NMOS transistor are further configured to receive the bias current Iptc having the temperature coefficient, and the temperature coefficient is adjustable to compensate for a temperature coefficient of the adjustable resistor.

3. The LDO according to claim 2, wherein a temperature coefficient of the adjustable resistor is a zero temperature coefficient.

4. The LDO according to claim 1, wherein the source of the second NMOS transistor is grounded through a stabilizing capacitor, wherein the stabilizing capacitor is used to keep a voltage input to the load circuit unchanged.

5. A microcontroller unit (MCU), comprising: an LDO according to claim 1.

6. The MCU according to claim 5, wherein the reference voltage generating circuit comprises: a first N-metal-oxide-semiconductor (NMOS) transistor and an adjustable resistor, and a gate and a drain of the first NMOS transistor are connected to the first terminal of the source follower, and a source of the first NMOS transistor is grounded through the adjustable resistor.

7. The MCU according to claim 6, wherein the gate and the drain of the first NMOS transistor are further configured to receive a bias current Iptc having an adjustable temperature coefficient.

8. The MCU according to claim 6, wherein the source follower comprises: a second NMOS transistor, wherein a gate of the second NMOS transistor is connected to the drain of the first NMOS transistor, a source of the second NMOS transistor is used to connect to the load circuit, and a drain of the second NMOS transistor is connected to a power supply voltage.

9. The MCU according to claim 8, wherein the first NMOS transistor and the second NMOS transistor are of a same type, and a channel length of the first NMOS transistor is the same as a channel length of the second NMOS transistor.

10. A fingerprint module, comprising: an MCU according to claim 5.

11. A terminal device, comprising: a fingerprint module according to claim 10.

12. The LDO according to claim 1, wherein an output voltage $V_{out}$ of the source of the second NMOS transistor is determined by the following formula:

$$\begin{aligned} V_{out} &= V_{ref} - V_{gsM2} \\ &= I * R_0 + V_{gsM1} - V_{gsM2} \\ &= I * R_0 + (V_{odM1} + V_{thM1}) - (V_{odM2} + V_{thM2}) \\ &= I * R_0 + V_{odM1} + V_{odM2} \\ &= I * R_0 + \Delta V_{od} \end{aligned}$$

wherein, $V_{ref}$ represents the reference voltage, $V_{gsM1}$ represents a voltage between the gate and the source of the first NMOS transistor, $V_{gsM2}$ represents a voltage between the gate and the source of the second NMOS transistor, I represents the bias current, $R_0$ represents the adjustable resistor, $V_{odM1}$ represents an overdrive voltage of the first NMOS transistor, $V_{odM2}$ represents an overdrive voltage of the second NMOS transistor, and $\Delta V_{od}$ represents an overdrive voltage difference between the first NMOS transistor and the second NMOS transistor.

13. The LDO according to claim 12, wherein the temperature coefficient of the bias current Iptc is adjustable to compensate for a temperature coefficient of the adjustable resistor and/or a temperature coefficient of $\Delta V_{od}$.

14. The LDO according to claim 12, wherein an adjustable range of the temperature coefficient of the bias current Iptc is −200 ppm/° C.~+200 ppm/° C., and the adjustable range of the temperature coefficient of the bias current Iptc comprises an end point value.

* * * * *